US007168460B2

(12) United States Patent
Dietrich et al.

(10) Patent No.: US 7,168,460 B2
(45) Date of Patent: Jan. 30, 2007

(54) APPARATUS FOR DECANTING PULVERULENT PRODUCT AND METHOD WHICH CAN BE CARRIED OUT USING SAID APPARATUS

(76) Inventors: Yves Dietrich, 1316 Chevilly (CH); Frédéric Dietrich, Ch. Pré-Lébaz 20, 1054 Morrens (CH)

( * ) Notice: Subject to any disclaimer, the term of this patent is extended or adjusted under 35 U.S.C. 154(b) by 47 days.

(21) Appl. No.: 11/138,774

(22) Filed: May 26, 2005

(65) Prior Publication Data

US 2005/0263209 A1 Dec. 1, 2005

(30) Foreign Application Priority Data

Jun. 1, 2004 (DE) ..... 10 2004 026 944
Jul. 3, 2004 (DE) ..... 10 2004 032 300

(51) Int. Cl.
*B65B 1/04* (2006.01)

(52) U.S. Cl. ..... 141/10; 141/114; 141/316; 141/391; 414/217

(58) Field of Classification Search ..... 141/10, 141/114, 98, 313–319, 391; 414/292
See application file for complete search history.

(56) References Cited

U.S. PATENT DOCUMENTS 3,128,837 A 4/1964 Gibbons
4,235,067 A 11/1980 Parsons
4,991,633 A 2/1991 Wong
5,144,992 A * 9/1992 Jaerger et al. ..... 141/346
5,735,321 A * 4/1998 Martyn et al. ..... 141/383
5,794,407 A * 8/1998 Smekens ..... 53/428

* cited by examiner

*Primary Examiner*—Steven O. Douglas
(74) *Attorney, Agent, or Firm*—Bachman & LaPointe, P.C.

(57) ABSTRACT

An apparatus for decanting pulverulent product (Q) into a receptacle (50) made of deformable material which receptacle is arranged in a container made of rigid material and is temporarily placed upstream of a lock system containing so-called glove boxes, a shaft (64) is rotatably mounted at a distance (n) from an adjustable base (B), on which shaft at least one hood designed as a glove box, at least one hood trough (80) made of metallic material, preferably of stainless steel, is fixed; at least one support plate (78) for the rigid container is attached to length-adjustable piston/cylinder units (76) at an adjustable distance from the shaft (64), the support plate being parallel to the shaft longitudinal axis (N), and the rigid container is sealingly connected at the other end to a connecting tube ($\mathbf{34}_a$) which projects into the hood or the hood trough (80) or the hood system.

35 Claims, 14 Drawing Sheets

34
35
44
36
52
51
39
b
42
43
41
38
40

38
51
50
47
48
46
Q
12
A
28
52
20
22
24
IX
16

43
51
25
47
48
12
16
38
46
A
34
28
50
22
X
24
20
52

22
43
51
24
47
20
48
52
12
16
38
36
44
28
A
50
34
46
14
Z

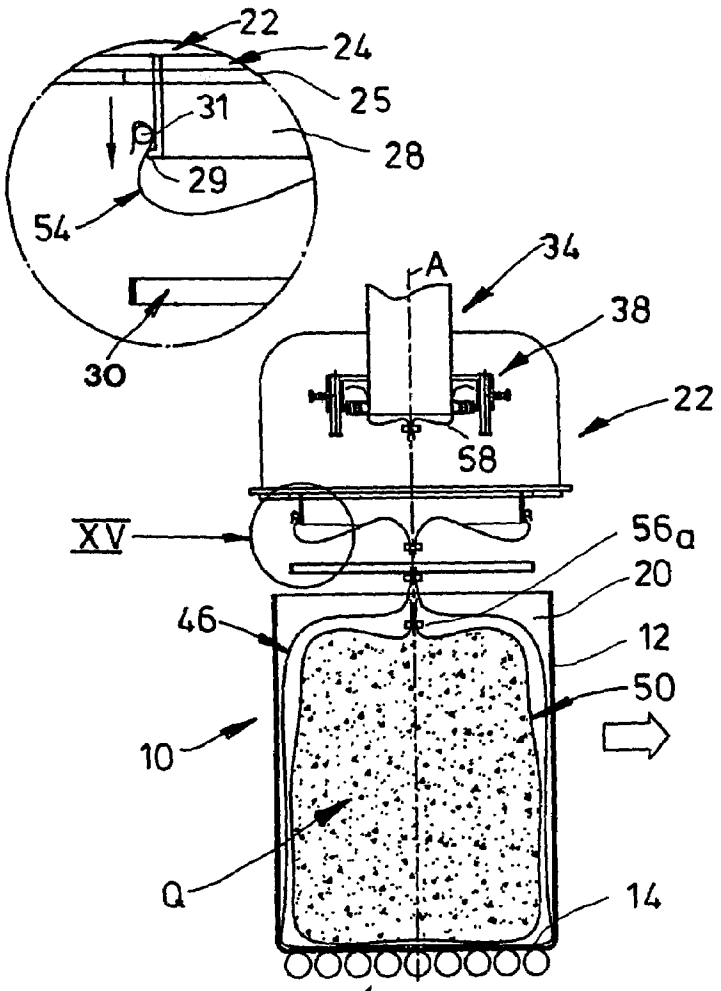
Fig.14
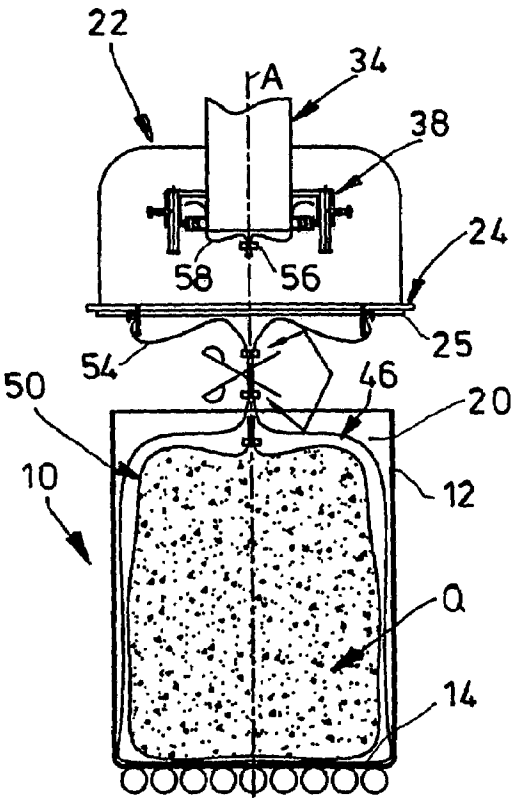
Fig.15
Fig.13

Fig.16
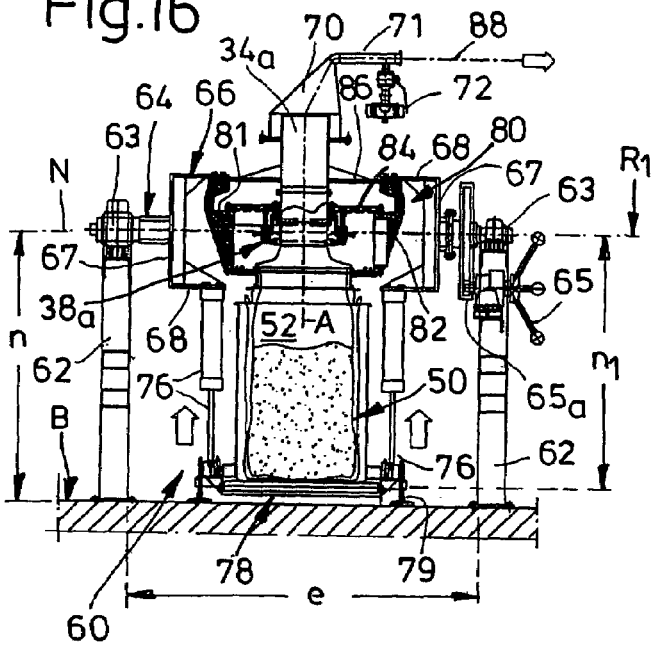
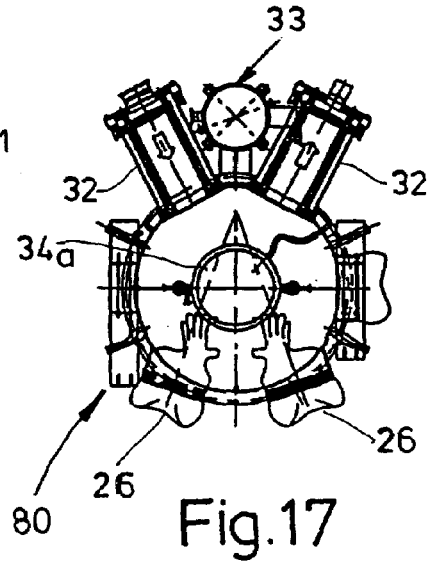
Fig.17
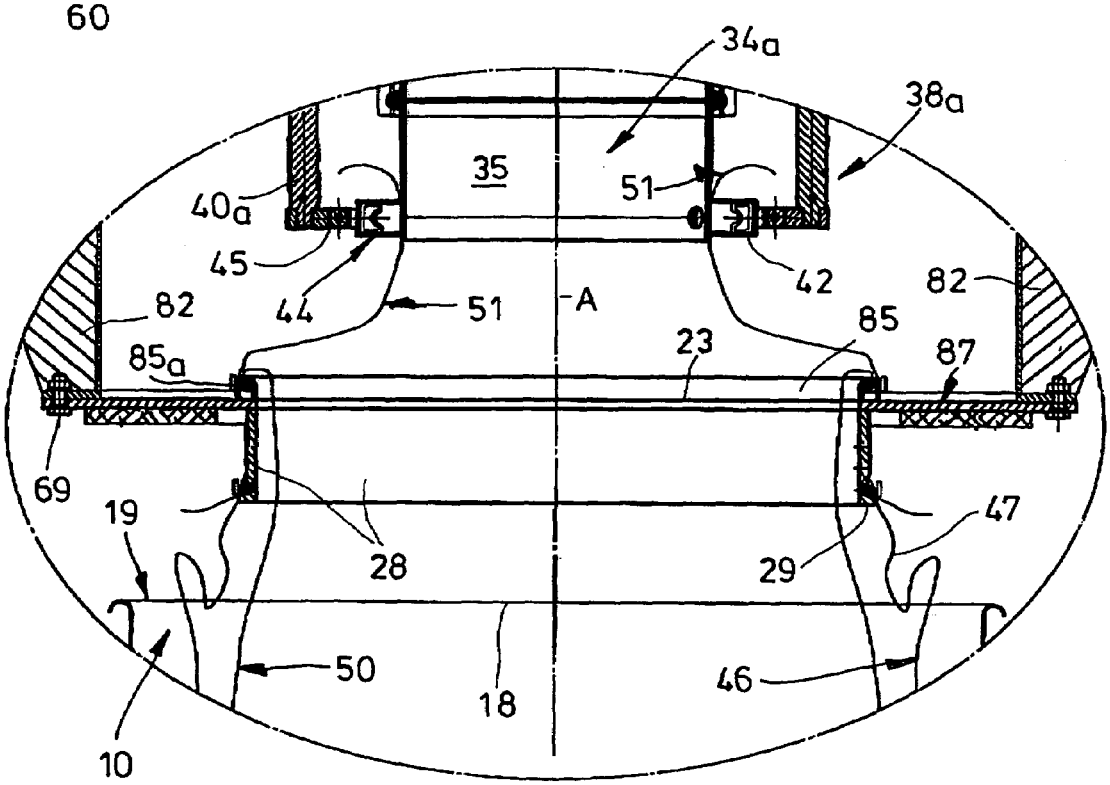
Fig.18

61
110
116
69
87
82a
40
41
44
A
34a
112t
23
38
43
85
84
28
M
63
113
80a
66a
68
76
62
10
79
111
114
34a
87
28
85
116
A
N
38
87
78
112
112t
113
76
62
64
63
114
82a
B
g
f 78
79
50
10
Q
76
76
120
68
66
80b
67
63
64
65a
34a
63
124
124
q
122
38
34a
68
66
65
50
10a
80b
46
76
76
62
62
Q
B
78
79

APPARATUS FOR DECANTING PULVERULENT PRODUCT AND METHOD WHICH CAN BE CARRIED OUT USING SAID APPARATUS

BACKGROUND OF THE INVENTION

The invention relates to an apparatus for decanting pulverulent product into a receptacle made of deformable material—in particular into a bag—which receptacle or bag is arranged in a container made of rigid material and is temporarily placed upstream of a lock system containing so-called glove boxes, according to the preamble of Patent Claim 1. The invention moreover relates to a method which can be carried out using said apparatus.

Various systems are known which can be used to empty toxic powder out of drums equipped with plastic bags, in such a way that there is little contamination. One of the most common methods is the use of isolation systems. The drum is introduced into the isolator through a lock, lifted by a mechanical device, and then the plastic bag filled with the product is opened by an operator using gloves. The product is then emptied manually into a funnel which is connected to the lower part of the isolator. The disadvantage of these isolation systems is that they are designed for specific applications and therefore have only a very small degree of flexibility. The space requirement and investment costs of such systems are considerable. Moreover, a considerable amount of dust is produced within the isolator, so that the filters rapidly become blocked, the system has to be cleaned frequently and there is a risk that product will be lost.

There is also a system which contains a transparent cylindrical glove box, as it is known, with side openings for gloves. A stainless steel ring with a flat seal is fixed to the lower part of the glove box and provides a seal with respect to the drum. A movable suction lance is introduced from above, which suction lance is connected to the glove box through a sealing sleeve. The system is connected to a pneumatic lifting device which allows the glove box to be raised and lowered above the drum. The drum is emptied by an operator with the aid of the suction lance, which is connected to a pneumatic conveyor system. The powder is conveyed under vacuum and emptied in a completely closed manner into the containers which are to be filled.

Compared to a conventional isolator, the advantages of such a system are a small space requirement and reduced investment costs. Depending on the type of product, however, the use of the suction lance may prove to be taxing and time-consuming. Moreover, it is sometimes difficult to completely empty the plastic bag. Furthermore, the system cannot be used for products which contain lumps. When emptying a large number of drums (>10 drums), the emptying time for a unit of product may prove to be very long and unsatisfactory (10–15 min/drum).

In view of this, the inventor set himself the aim of eliminating the recognized problems. In particular, it is to be possible for drums equipped with plastic bags which contain toxic powder to be emptied virtually without any contamination (<1 $\mu g/m^3$) and in a semi-automatic manner.

SUMMARY OF THE INVENTION

The object is achieved according to the invention, wherein a rotatable shaft is mounted—preferably on at least two side stands which are arranged at a lateral distance from one another and form a main frame—at a distance from an adjustable base, on which shaft at least one hood designed as a glove box—or a hood trough or a hood system—is fixed. Moreover, at least one support plate as a holding base for the rigid container is attached to length-adjustable piston/cylinder units at an adjustable distance from the shaft, said support plate being parallel to the shaft longitudinal axis; the rigid container is designed such that it can be sealingly connected at the other end to a connecting tube which projects into the hood, the hood trough or the hood system.

According to a further feature of the invention, the hood or the hood trough—or the outer region of the hood system—is formed of metallic material, preferably of stainless steel, and is provided at least in the part remote from the base with a window element; gloves or glove-like devices are provided in openings at a front region, into which gloves or glove-like devices an operator can insert his hands in order to open the inner bags of the drums or receptacles without any contamination.

It has proven advantageous to connect the rigid container or the drum to the hood or hood trough or hood system by pneumatic pistons which are fitted at the side. These pistons seal the system by pressing the drum against the adjacent lower plate of the apparatus which is provided with a seal.

According to another feature of the invention, the hood or hood trough or hood system is fitted in a receiving compartment of the shaft, from which the above-mentioned piston/cylinder units for the support plate project.

This system is installed on a so-called main frame which has a pair of—more or less radial—end walls of the receiving compartment which are close to the shaft mountings on side stands for the shaft and from which axis-parallel longitudinal walls project in each case; two longitudinal walls which are aligned with one another are designed as connection elements for the piston/cylinder units.

It has proven advantageous to fix the hood or hood trough to the longitudinal walls of the receiving compartment which are remote from the piston/cylinder units. Moreover, the hood or hood trough should extend through at least one axis-parallel plate which is passed through by the connecting tube.

According to a further feature of the invention, a tension frame is assigned to the connecting tube, by means of which tension frame a pressing pressure can be generated on the outer face of the tube wall, by virtue of which pressure the free end of the bag can be fixed to the connecting tube. To this end, a pressure ring of the tension frame should be placed against the tube wall, which pressure ring is designed to be displaceable in a radial and/or axis-parallel direction; this pressure ring is preferably provided as a flexible and inflatable profile. The pressure ring is advantageously held by at least one sliding foot which guides it, which sliding foot surrounds an axis-parallel tension arm of the tension frame and can be displaced on said tension arm in an axis-parallel manner and fixed at a desired location.

Advantageously, the mouth region of the receptacle made of deformable material—that is to say of the bag—can be fixed between the tension frame and the connecting tube. Said receptacle for receiving the pulverulent product should be arranged as an inner bag within an outer bag which surrounds it as a cover; both bags are located in the aforementioned rigid container, that is to say the drum of the apparatus. The mouth region of the covering or outer bag is preferably fixed on an annular fixing device which surrounds an opening—assigned to the rigid container or drum—of the hood or hood trough or hood system. Said fixing device is a profile ring which surrounds the opening, wherein the outer face of said profile ring is assigned at least one pressure profile as a clamping element for the mouth region of the outer bag. A foot web should be integrally formed towards the outside of the profile ring as a support for a pressure profile.

According to the invention, the connecting tube is connected to a pneumatic conveyor system by means of a connecting element, wherein the connecting element preferably tapers away from the connecting tube in a funnel-like manner. Moreover, the connecting element should be equipped with a device which breaks up agglomerations or lumps which may be present in the pulverulent product, for example a grinding mechanism.

It is particularly important that the apparatus is equipped with a manual or automatic tilting device, by means of which the system can be tilted by 180°. The upper part of the system can—depending on the application—be equipped with various connections. The system consists in any case of a connecting tube with an inflatable seal, against which the inner bag is to be fixed.

In order to prevent the inner bag from falling down when the drum is tilted and thus hindering complete emptying of the drum, certain steps must be taken when fixing the bag. The previously opened inner bag is firstly fixed by means of an O-ring to a ring welded to the bag holder. The upper part of the bag is then fixed to the connecting tube, which is installed at the top in the system with an inflatable seal. Since the space between the bag and the drum is closed, the bag is usually held back during the emptying operation. It is also possible to place this space under slight negative pressure in order to ensure that the bag is securely held.

In one embodiment of the invention, a processing unit which can rotate with the shaft is arranged on the latter, from which processing unit the connecting tube extends in the radial direction with respect to the shaft; one compartment half of the processing unit which holds said connecting tube is assigned to the receiving compartment of the apparatus and the other compartment half is provided with a closable filling element. To this end, it is particularly advantageous for there to be at least one compartment half which in terms of its cross section tapers away from the shaft; a closure member should be arranged between the connecting tube and the compartment half which tapers towards the connecting tube.

A common bushing which surrounds the shaft adjoins the compartment halves on either side, wherein a radial panel element for connection to the receiving compartment is fixed to the bushing. In particular, a motor is connected to the shaft of this apparatus.

The scope of the invention also encompasses a connecting funnel which is connected by a hose to a pneumatic conveyor system and is fixed to the connecting tube in the upper part of the hood. Once the drum has been connected to the system, it is tilted and automatically emptied by the conveyor system. In the case of products which do not flow very well, a back-and-forth movement may be applied in order to break possible powder bridges. Advantageously, the lower plate of the hood may be made of a porous material in order to replace the filter of the suction funnel.

The scope of the invention also encompasses a method for decanting pulverulent product into a receptacle made of deformable material, in which the bag which receives the product is placed in another bag and is arranged together with the latter in the rigid container, whereupon the rigid container is sealingly connected to a hood designed as a glove box or to a hood trough or to a hood system and the mouth region of the open inner bag is connected to a connecting tube. The product is fed to a reactor or else is fed to another inner bag in a metered manner.

The system according to the invention can therefore be used to fill and empty for example rotating processing units—biconical dryers, mixers or the like—in a closed manner. The hood is continuously connected to the processing unit. A drum filled with raw material is attached to the system and loaded into the apparatus by the force of gravity once it has been tilted by 180°. At the end of processing—which comprises drying and mixing operations, the powder is loaded into a new drum.

The system according to the invention can also be used as a dispensing unit; in the pharmaceutical industry, it is often customary to decant a container containing raw material into smaller, precise loads.

It is also possible to meter a precise amount of powder from one drum into a second drum by placing two hood systems on weighing scales, said hood systems being separated by a metering valve.

BRIEF DESCRIPTION OF THE DRAWINGS

Further advantages, features and details of the invention will emerge from the following description of preferred examples of embodiments and with reference to the drawing. In the drawing:

FIGS. 1, 2, 4, 6 to 8, 10 to 14: show a device in different operating positions with a drum or container for receiving bags;

FIGS. 3, 5 show an enlarged detail from FIG. 2 at the arrow III therein and from FIG. 4 at the arrow V therein, respectively;

FIGS. 9, 15 show an enlarged detail from FIG. 8 and FIG. 10 at the arrow IX therein and from FIG. 14 at the arrow XV therein, respectively;

FIG. 16 shows a partially cut-away diagram of a holding apparatus for the device as shown in FIGS. 1 to 15 for actuation thereof;

FIG. 17 shows a partial section through

FIG. 16 in the radial plane R therein;

FIG. 18 shows an enlarged detail from FIG. 16;

DETAILED DESCRIPTION

Figures 1, 2, 3, 4, 5:
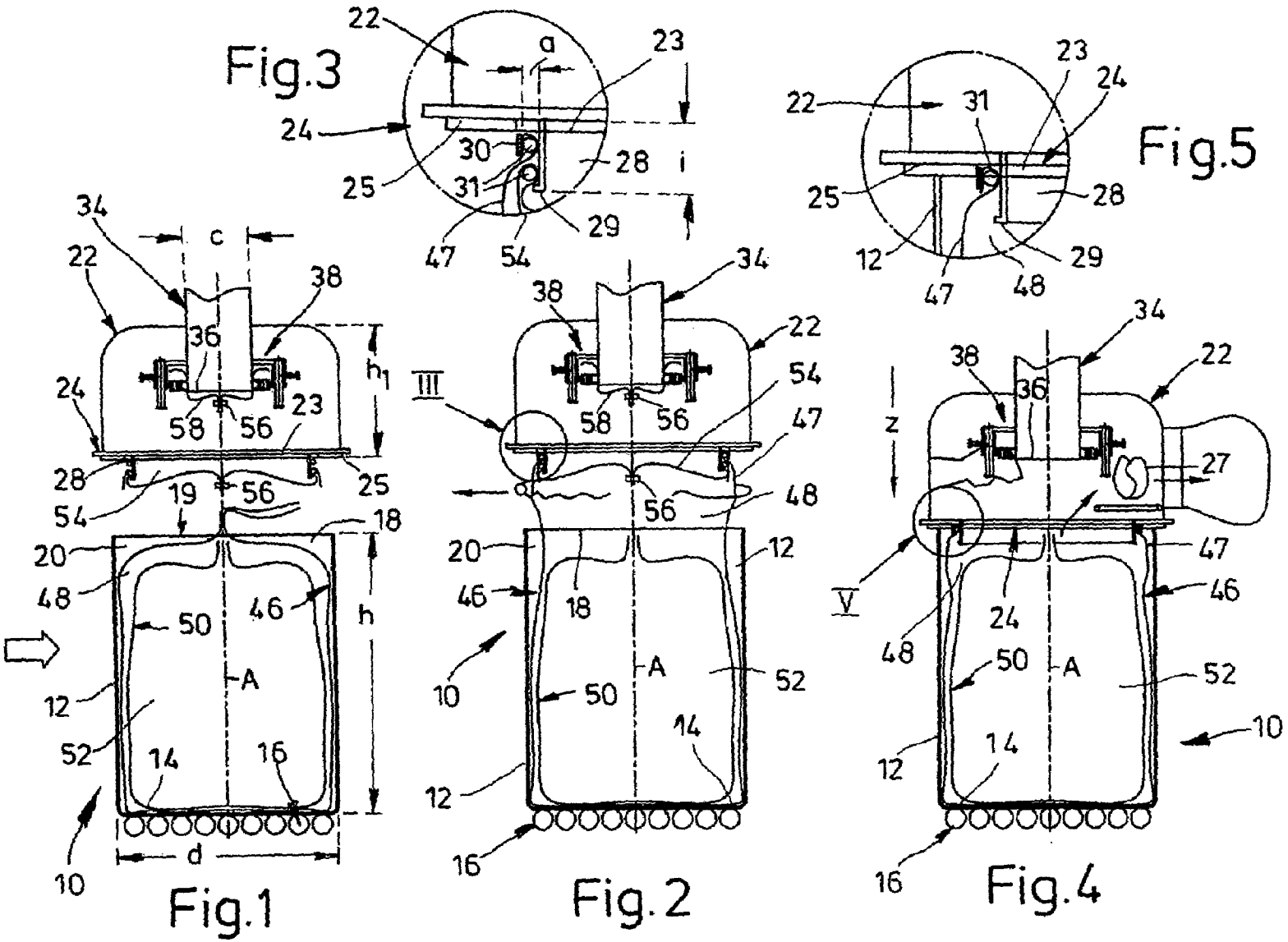

A drum-like container 10 of diameter d and height h is placed with its baseplate 14—integrally formed on a container wall 12—on a grate 16. A hood 22 of height $h_1$ which is made of stainless steel and has a glass window (not visible in the drawing) in the upper region is arranged on a vertical tube 34 of diameter c above the upwardly pointing mouth opening 18 of the drum or container 10, coaxial to the vertical axis A thereof, it being possible for said hood to be lowered onto said vertical tube in the closure direction z.

Following the lowering operation, an annular circumferential edge 24 of the hood 22 which is graduated downwards and inwards in cross section bears with its lower sealing portion 25 on the upper edge 19 of the container wall 12 which surrounds the mouth opening 18, as shown in FIG. 4. The drum or container 10 is connected to the hood 22 by pneumatic pistons which are fitted at the sides of the system. These pistons seal the system by pressing the drum 10 against the circumferential edge 24 of the system—which as already mentioned is provided with a seal. A waste bag 27 can be seen here above the circumferential edge 24, which waste bag receives the below-described tension faces 54, 48 following removal thereof. Not shown in FIG. 4 are two gloves 26 which are both attached to the front side of the hood 22 in openings. Two filters 32 of the "push-through" type are also provided opposite the gloves 26 (FIG. 17).

It can be seen in particular from FIGS. 3, 5 that a profile ring 28 of angular cross section and of height i projects downwards from the circumferential edge 24, wherein the outer side of said profile ring—which ends in an integrally formed, outwardly directed foot web 29—has a tension belt 30 lying opposite it at a radial distance a.

Figures 6, 7, 8, 9:
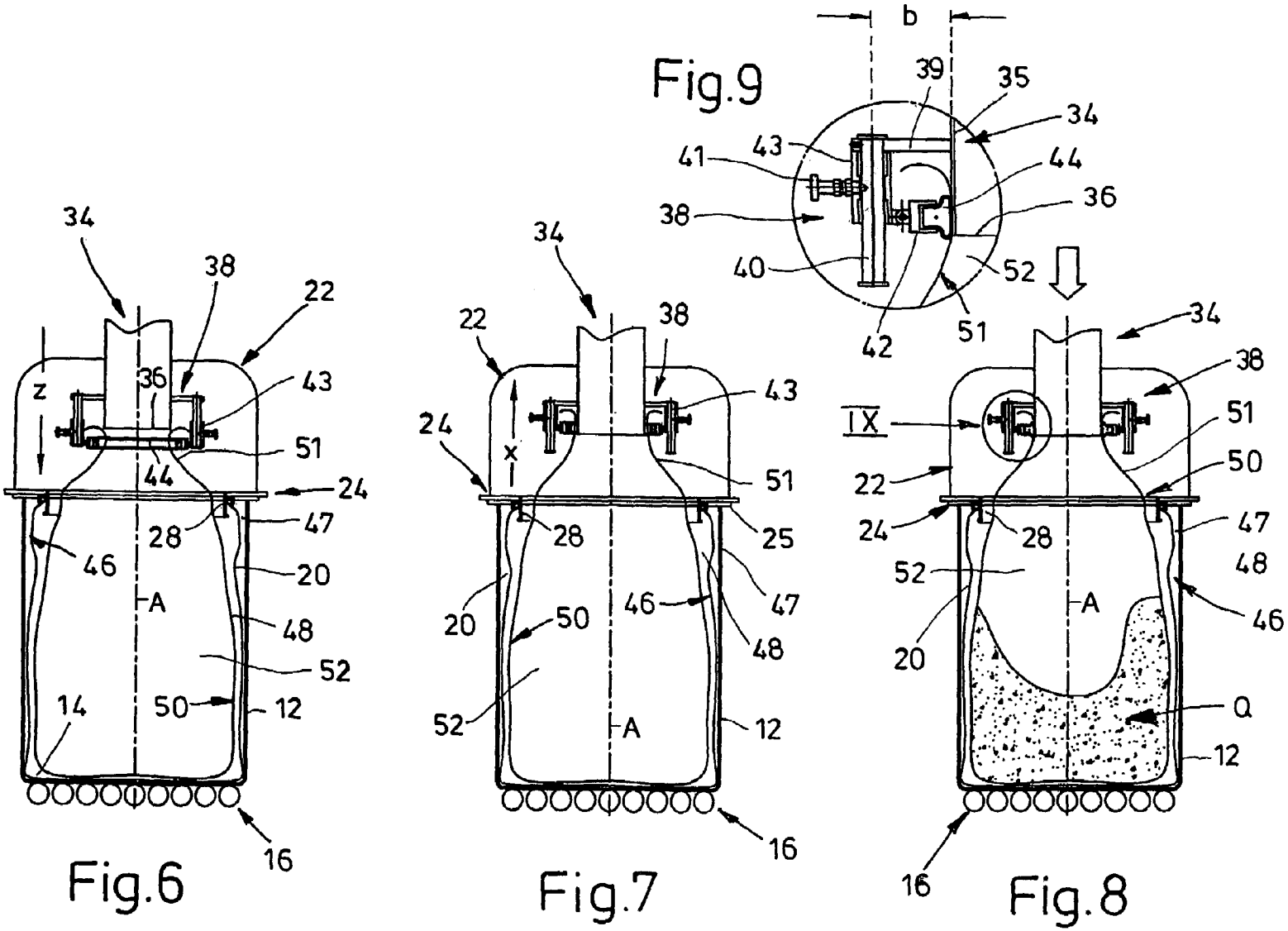
Figure 12:
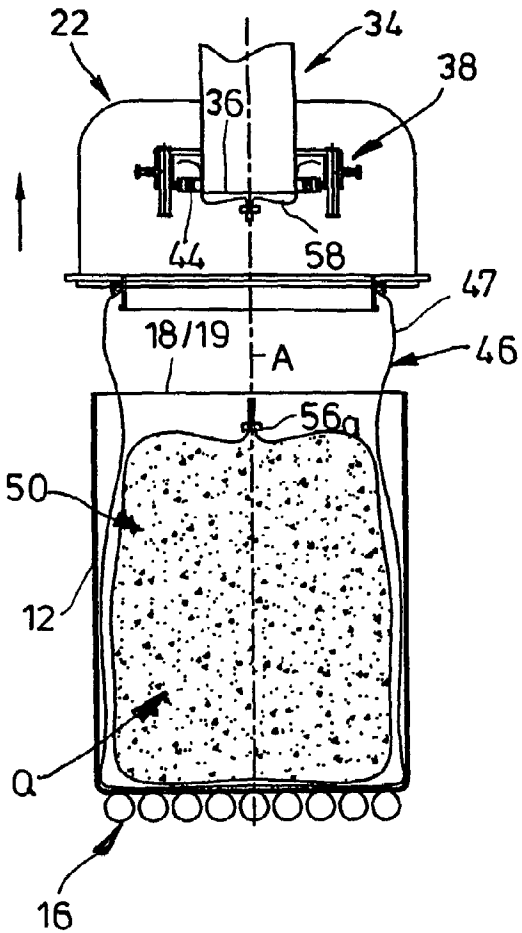
Figure 11:
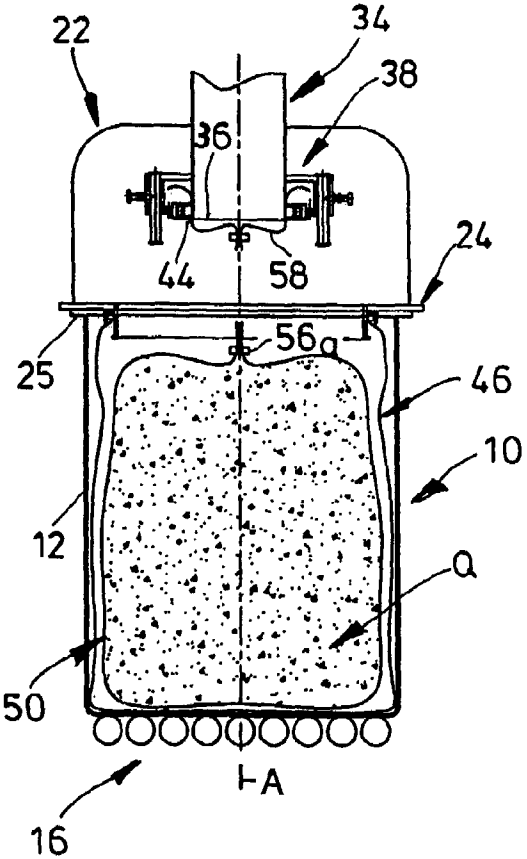

Above its mouth edge 36, the vertical tube 34 is assigned a tension frame 38, the design of which is shown particularly clearly in FIG. 9; a pressure profile 42 projects from an axis-parallel tension arm 40 thereof—which is arranged at a central distance b from the wall 35 of the vertical tube 34 on a radial bar 39—towards the vertical tube 34, which pressure profile can be moved in an axis-parallel manner by virtue of a sliding foot 43 which surrounds the tension arm 40—by actuating an adjustment handle 41—and can be guided against the vertical tube 34 by the—possibly inflatable—sealing member designed as a pressure ring 44 made of elastic material.

Shown within the interior space 20 of the drum or container 10 is a bag 46 which is arranged about the vertical axis A, the upper mouth region 47 of which bag is connected to said profile ring 28 of the hood 22 by a round profile 31 in the open state shown in FIGS. 2, 4, 6 to 12 and the interior space 48 of which bag receives an inner bag 50 for pulverulent product Q. When the hood 22 is located as shown in FIGS. 1, 2 at a distance from the upper edge 19 of the container 10, a hood opening 23 delimited by the tension frame 28 is closed by a tension face 54, which tension face is in turn pressed against the outer face of the profile ring 28 by an O-ring or round profile 31, as shown in FIG. 3. This tension face 54 may be formed for example by a portion of the mouth region 47 of the previously handled—and then cut—outer bag 46, and may be clamped by a central clamp 56.

Figure 10:
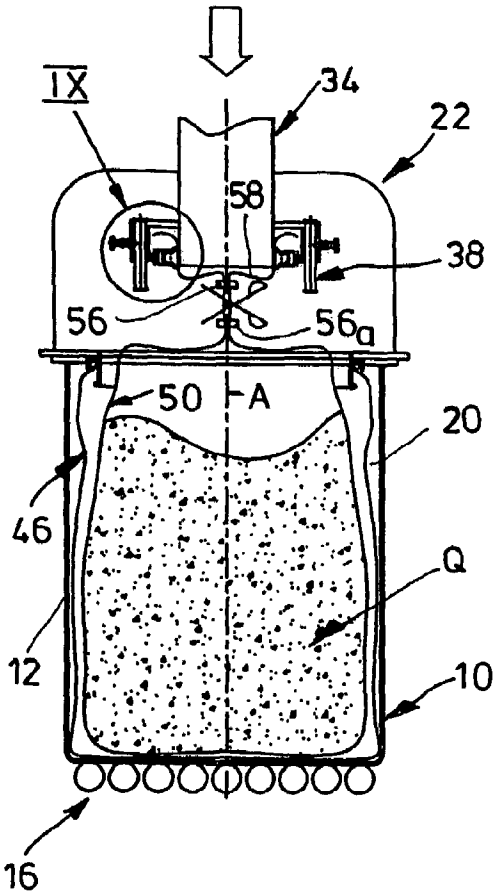

By virtue of the two gloves 26 attached to the hood front, the inner bag 50 in the closed drum or container 10 can be opened from outside by an operator without any risk and its mouth region 51 can be fed to the pressure ring 44. As shown in FIGS. 6 to 10, once the sliding foot 43 on the tension arm 40 has been raised in the direction of the arrow x, the mouth region 51 of the inner bag 50 is pressed against the outer face of the wall 35 of the vertical tube 34 by the above-mentioned pressure ring 44, and said vertical tube 34 is thus connected to the bag space 52. Once the latter has been filled by introducing the pulverulent product Q, its mouth region 51 is removed and closed by a clamp 56 as shown in FIG. 10; it then serves as a tension face 58 for closing the vertical tube 34. A further clamp $\mathbf{56}_a$ closes the remaining inner bag 50. The latter is pressed into the container interior 20. Shown in FIG. 14 is the abovementioned flat profile or tension belt 30 which is released in order to move the O-ring 31 downwards.

By virtue of a rotary device 60 as a main frame which is shown in FIGS. 16, 18, the inner bag 50 is rapidly emptied in a simple manner. This rotary device 60 has, at a clear distance e from one another, two side stands 62 which are fixed to an adjustable base B and are each provided with a shaft mount 63, between which a rotatable receiving compartment 66 is located on a shaft 64, the longitudinal axis N of which shaft runs at a distance n from the adjustable base B; said receiving compartment has, on two radial end walls 67, in each case two shaft-parallel longitudinal walls 68 and contains a hood trough 80 in which the connecting tube $\mathbf{34}_a$ engages from above in FIG. 16. Within the compartment-like hood trough 80, a transverse plate 84 which is made of window glass and is parallel to the longitudinal axis N of the shaft 64 is fixed on axis-parallel shoulders 81 of the side wall 82, said transverse plate being passed through by the connecting tube $\mathbf{34}_a$. The latter is surrounded by a tension frame $\mathbf{38}_a$ which is made in one piece with the glass or transverse plate 84 and has essentially been described above. A transverse arm 45 projects at right angles from the free end of the axis-parallel tension arm $\mathbf{40}_a$ of said tension frame, wherein the pressure ring 44 is mounted in the channel-like pressure profile 42 of said transverse arm and in FIG. 18 presses the mouth region 51 of the inner bag 50 against the tube wall 35. This inner bag 50 passes through the hood opening 23—which in this case is located in a baseplate 87 parallel to two ridge profiles 86 of the hood trough 80—which surrounds the profile ring 28. The mouth region 47 of the outer bag 46 is fixed to the foot web 29 of said profile ring. Above the baseplate 87 screwed to the side wall 82, the profile ring 28 is continued by an add-on ring 85 which has clamping elements $\mathbf{85}_a$ for the inner bag 50 on its outer circumference.

At its other end, the connecting tube $\mathbf{34}_a$ opens into a connecting funnel 70, from which a joining tube 71 having a closure mechanism and filter 72 projects radially. Installed on the connecting funnel 70, which is connected by a hose to a pneumatic conveyor system, is a filter which makes it possible to draw out the conveyed air of the powder. Optionally, a lid 75 of the funnel 70 may be designed as a plate made of a porous material, in order to replace the filter of the suction funnel.

Axis-parallel piston/cylinder units 76 project from the radial longitudinal walls 67 of the receiving compartment 66 towards the base in FIG. 16, which piston/cylinder units are connected at the other end to a support plate 78, the clear shaft distance $n_1$ of which is adjustable. In the starting position, this support plate 78 is seated with adjustable feet 79 on the aforementioned adjustable base B and serves as a support face for the drum or container 10. The bags 46, 50 thereof are connected to the hood trough $\mathbf{22}_a$ in the above-described manner, so that the bag space 52 adjoins the connecting tube $\mathbf{34}_a$. In the cross section shown in FIG. 17, a filter for the powder is clearly shown at 33; said filter is connected to the upper part of the connecting funnel 70 (not visible in the drawing).

The previously opened inner bag 50 is firstly fixed on a ring welded to the bag holder with the aid of the round profile or O-ring 31. The upper part of the inner bag 50 is then fixed to the vertical or connecting tube $\mathbf{34}_a$, which is installed in the ridge region of the system by means of an inflatable seal. By actuating the piston/cylinder units 76 and shortening them, the space between the inner bag 50 and the drum 10 is closed for the emptying operation. It is also possible to place this space under slight negative pressure in order to ensure that the inner bag 50 is securely held.

Once the shaft 64 has been rotated through 180° by actuating a handwheel 65 with a drive member $\mathbf{65}_a$ connected downstream towards the shaft 64, the joining tube 71 of the connecting funnel 70 is connected by a conveyor hose 88 to a reactor unit 90 and specifically to a lateral shoulder connection piece 96 of a cylindrical tube 94 made of electrolytically polished stainless steel which projects from a reactor 92 and the interior 95 of which serves as a pumping chamber; this is connected to the conveyor hose 88 which serves as a supply line—conveying direction y. Said shoulder connection piece contains a so-called butterfly valve 89 as a closure member in a connection flange for the conveyor hose 88.

Shown above the lid 93 of the reactor 92 are a valve housing 98 and a drive element 99 for a butterfly valve. Towards the top, the cylindrical tube 94 ends at a filter insert 100 which is covered by a domed lid 104 provided axially with a T-shaped connection tube 102. Said domed lid is fixed by a locking device to coupling hooks of the cylindrical tube 94. Extending from the connection tube 102 is firstly a vacuum line 106 with vacuum valve 107 for a vacuum pump arranged upstream thereof, and secondly a conveying gas line 108 for a conveying gas source, said conveying gas line having a closure valve 109.

During a suction phase, the butterfly valve 89 of the supply line 88 opens and the discharge line remains closed. By virtue of a vacuum being built up via the vacuum line 106, the pumping chamber 95 then fills up to a desired filling level, or possibly completely.

After a predetermined period of time, the supply line 88 is closed and the discharge line is opened. Once the closure valve 109 in the conveying gas line 108 is opened, the powder Q is out under the action of pressure—for example by nitrogen for filter cleaning purposes. At the end of the suction phase, the vacuum line 108 remains open for a certain time before the butterfly valve of the discharge line is opened, in order to remove the oxygen from the pumping chamber 95.

Of particular importance during this operation is the filter in the filter insert 100, which holds back the powder and at the same time provides the suction capacity of the system. By virtue of its position between the pumping chamber 95 and the conveying gas source, the filter is cleaned during each cycle and thus maintains its full filtration capacity.

The closure elements 89, 107, 109 and the butterfly valve of the discharge line are connected to one another in terms of control technology at a control box. During a suction phase, the butterfly valve 89 of the supply line 88 opens whereas the discharge line remains closed. By virtue of the vacuum valve 107 which is open during this, the pumping chamber 95 sucks in powder until it is full; after a predetermined period of time, the supply line 88 closes and the discharge line is opened. The conveyed product is pushed out under the action of pressure—compressed air or nitrogen for filter cleaning purposes. The filter in the upper part of the cylindrical tube 94 holds back the very fine particles and is cleaned during each emptying cycle.

Prior to introducing the powder into the downstream reactor 92, air and powder are separated from one another by the closure of the vacuum shut-off valve 107 being delayed with respect to the opening of the conveyed product inlet. In order that no gases from the reactor 92 can be sucked in when the discharge line is opened, the cylindrical tube 94 is firstly placed under pressure and only then is the emptying valve opened. Moreover, the vacuum line 106 can be opened only when the discharge line is closed.

The drum 10 which is connected to the hood trough 80 and tilted is automatically emptied by the conveyor system. In the case of products which do not flow very well, a back-and-forth movement may be applied in order to break possible powder bridges.

Figure 19:
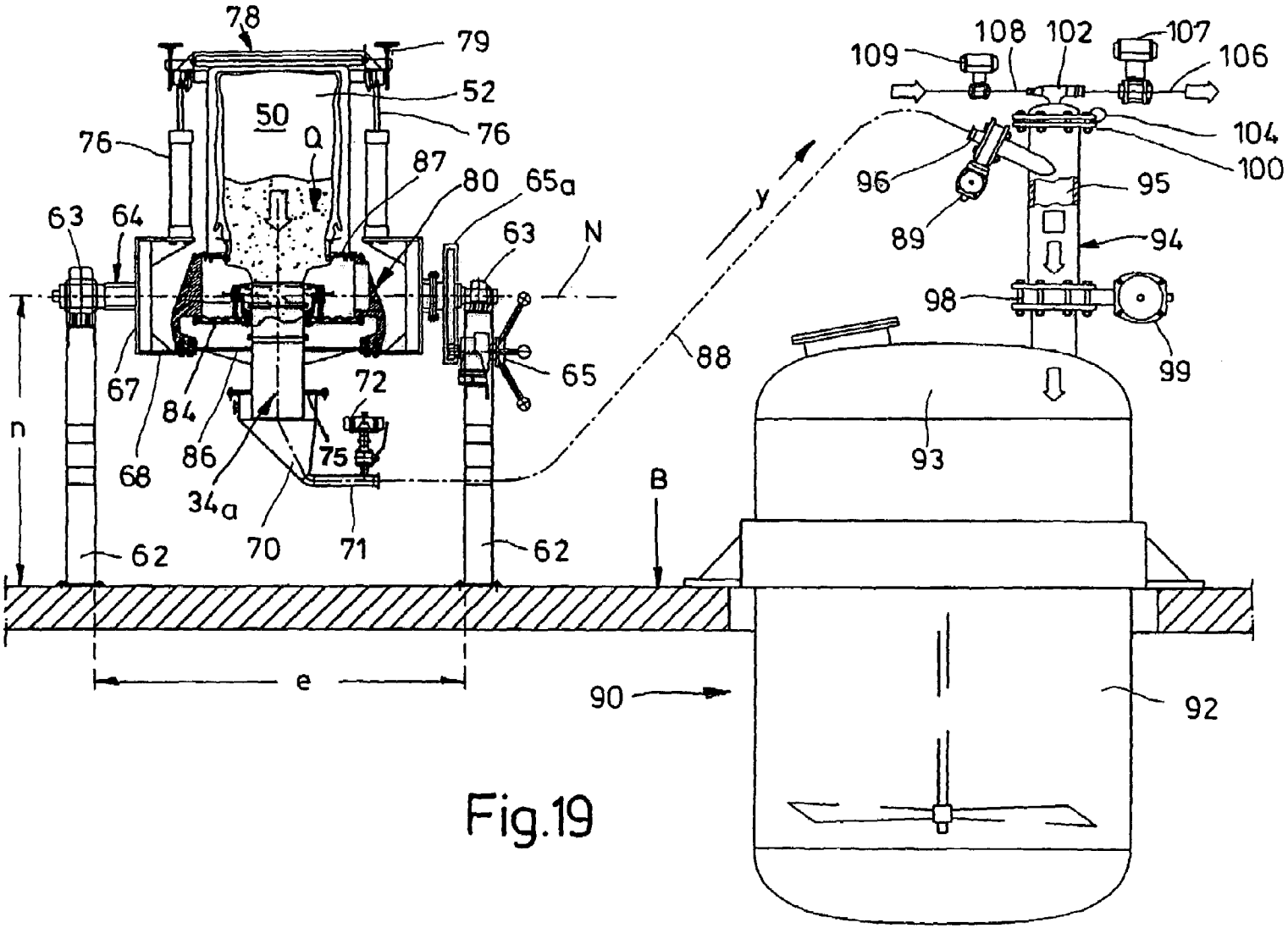
FIG. 19 shows the holding apparatus of FIG. 16 in a different operating position and with a connected reactor, in side view.
Figure 20:
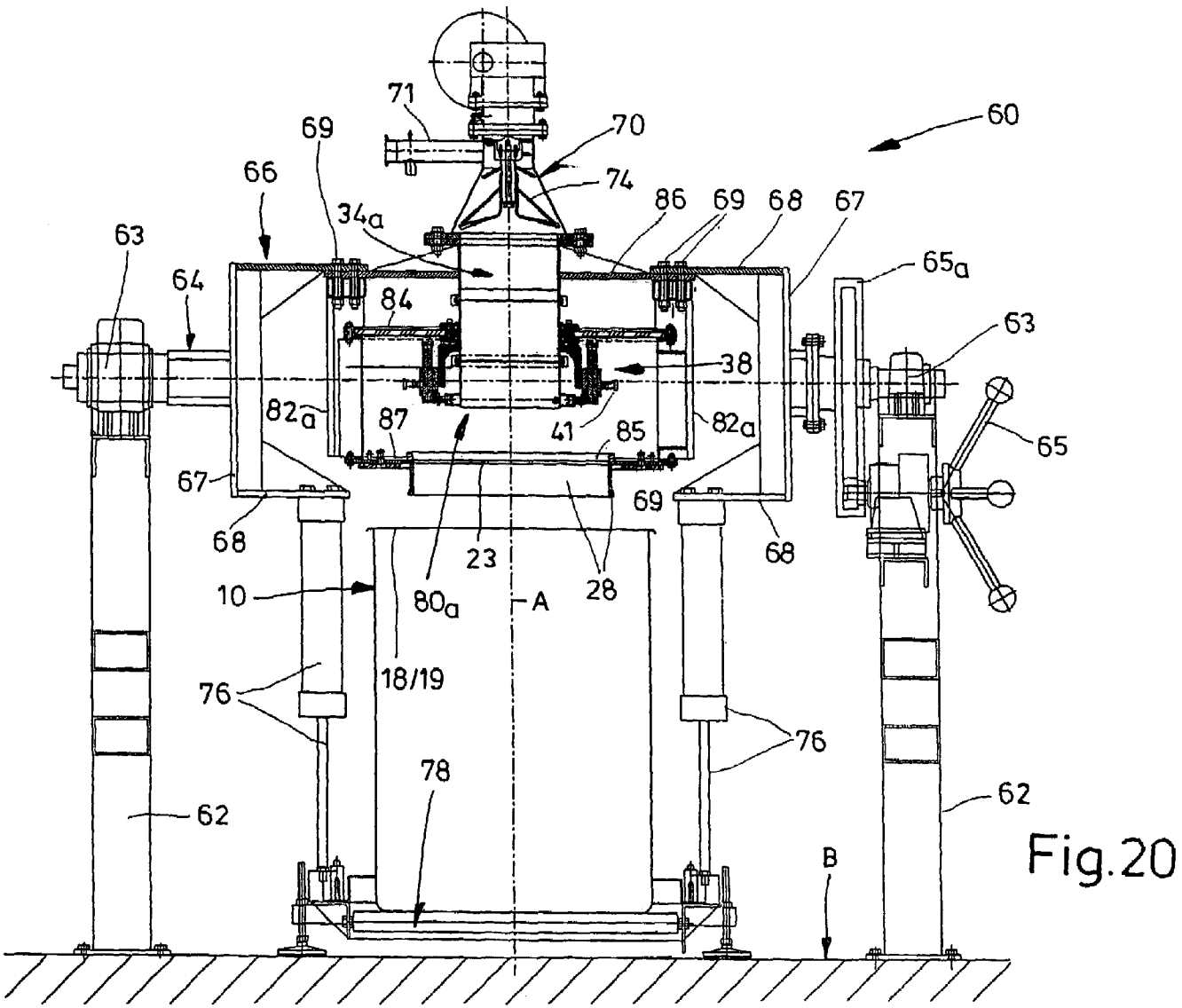
FIGS. 20, 21, 23 show in each case a side view of different embodiments of the holding apparatus.

If the product Q to be emptied contains lumps, a lump-breaking system shown at 74 in FIG. 20 may be integrated in the suction or connecting funnel 70. In this embodiment, the side walls $\mathbf{82}_a$ are of rectangular cross section and—like the side walls 82 of FIGS. 16, 19—are connected to the longitudinal walls 68 and the ridge plate 86 by screws 69.

Figures 21, 22:
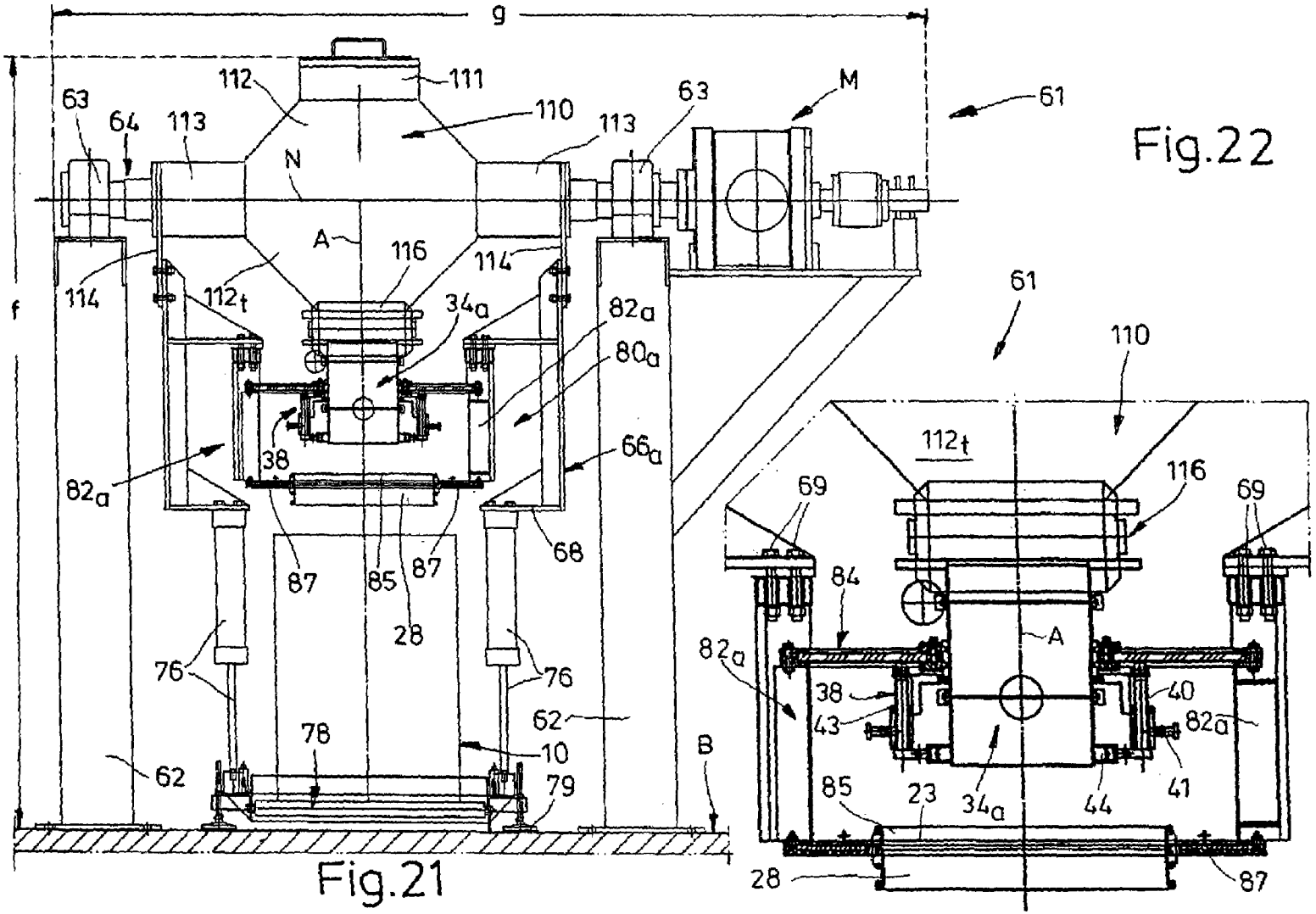
FIG. 22 shows an enlarged detail from FIG. 21.

The system according to the invention can also be used to fill and empty for example rotating processing units 100—biconical dryers, mixers or the like—in a closed manner. In FIG. 21, the hood system $\mathbf{80}_a$ lying in the vertical axis A of the apparatus 61 is permanently connected to the processing unit 110 and is loaded into the apparatus 61 by the force of gravity, once it has been tilted by 180°. At the end of the processing method—drying, mixing—the powder is loaded into a new drum 10. The shaft 64 of the apparatus 110 of overall height f of in this case 2200 mm and a length g of approximately 2500 mm is driven by a motor M which is fitted outside the side stands 62; between the latter, the shaft 64 passes through said processing unit 110 which contains two compartment halves 112, $\mathbf{112}_t$—each tapering away from the shaft 64—which are adjoined on either side by the bushings 113 which surround the shaft 64. A radial panel element 114 for a receiving compartment $\mathbf{66}_a$ to which the hood system $\mathbf{80}_a$ is connected is fixed to each of said bushings.

The upper compartment part 112 has a closable filling connection piece 111. The connecting tube $\mathbf{34}_a$ extends from the lower compartment part $\mathbf{112}_t$—with the interposition of a closure element 116—in the vertical axis A and passes through a tension frame 38 in this case, too.

The system according to the invention can also be used as a dispensing unit. In the pharmaceutical industry, it is often customary to decant a drum containing raw material into smaller, precise loads. Using the apparatus 120 shown in FIG. 23, it is possible to meter a precise amount of powder Q from one drum 10 to a second drum $\mathbf{10}_a$ by connecting two hood systems $\mathbf{80}_b$—which are at an axial distance q from one another and are separated by a metering valve 122—to weighing scales. These weighing elements—assigned to the two hood systems $\mathbf{80}_b$—bear the reference 124 in FIG. 23.

Figures 24, 25, 26, 27:
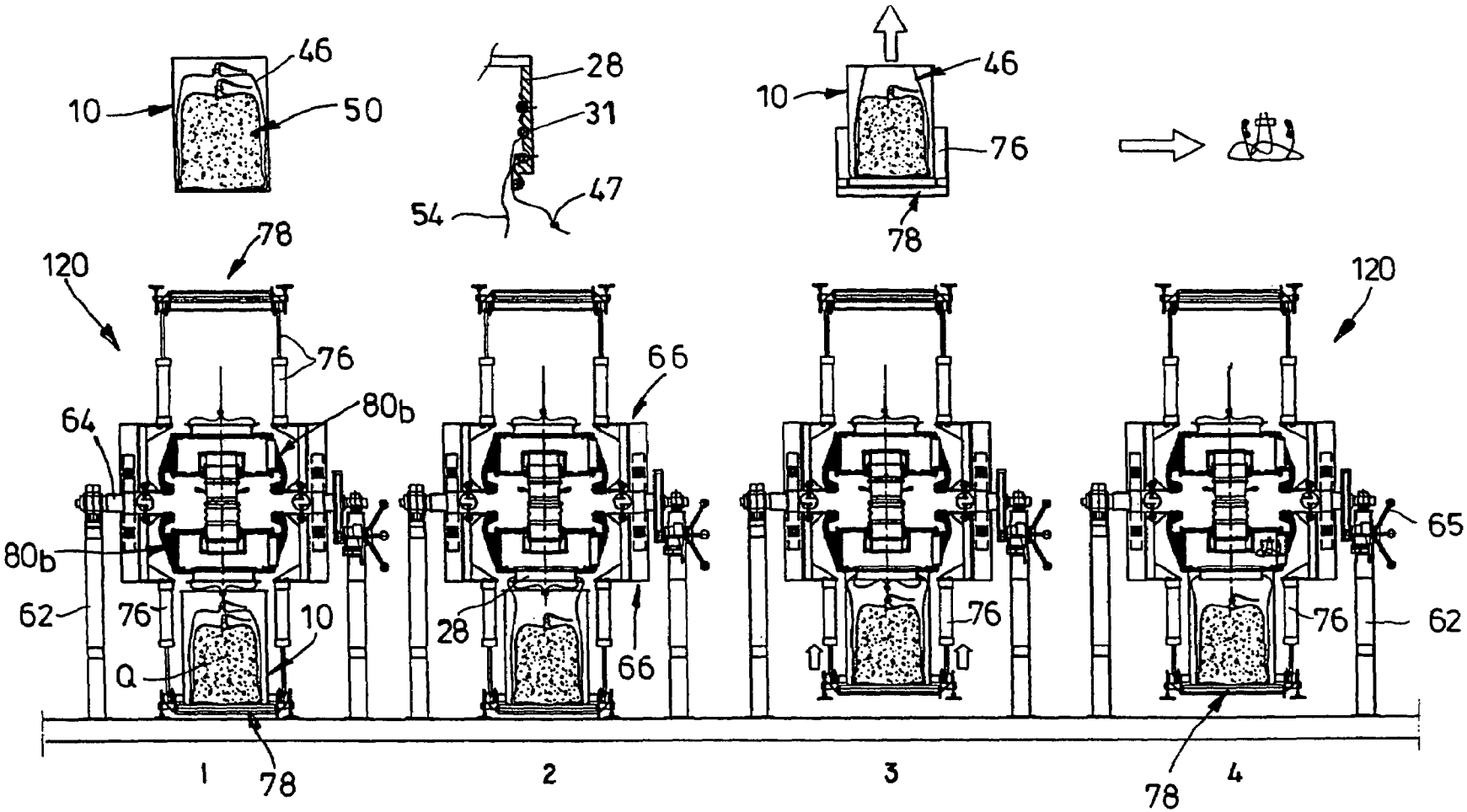
FIGS. 24 to 37 show in each case a diagram, corresponding to the diagram in FIG. 16, of the apparatus at different steps in the method, wherein a symbolic method diagram above each of the figures is assigned to each of said figures.
Figures 28, 29, 30, 31:
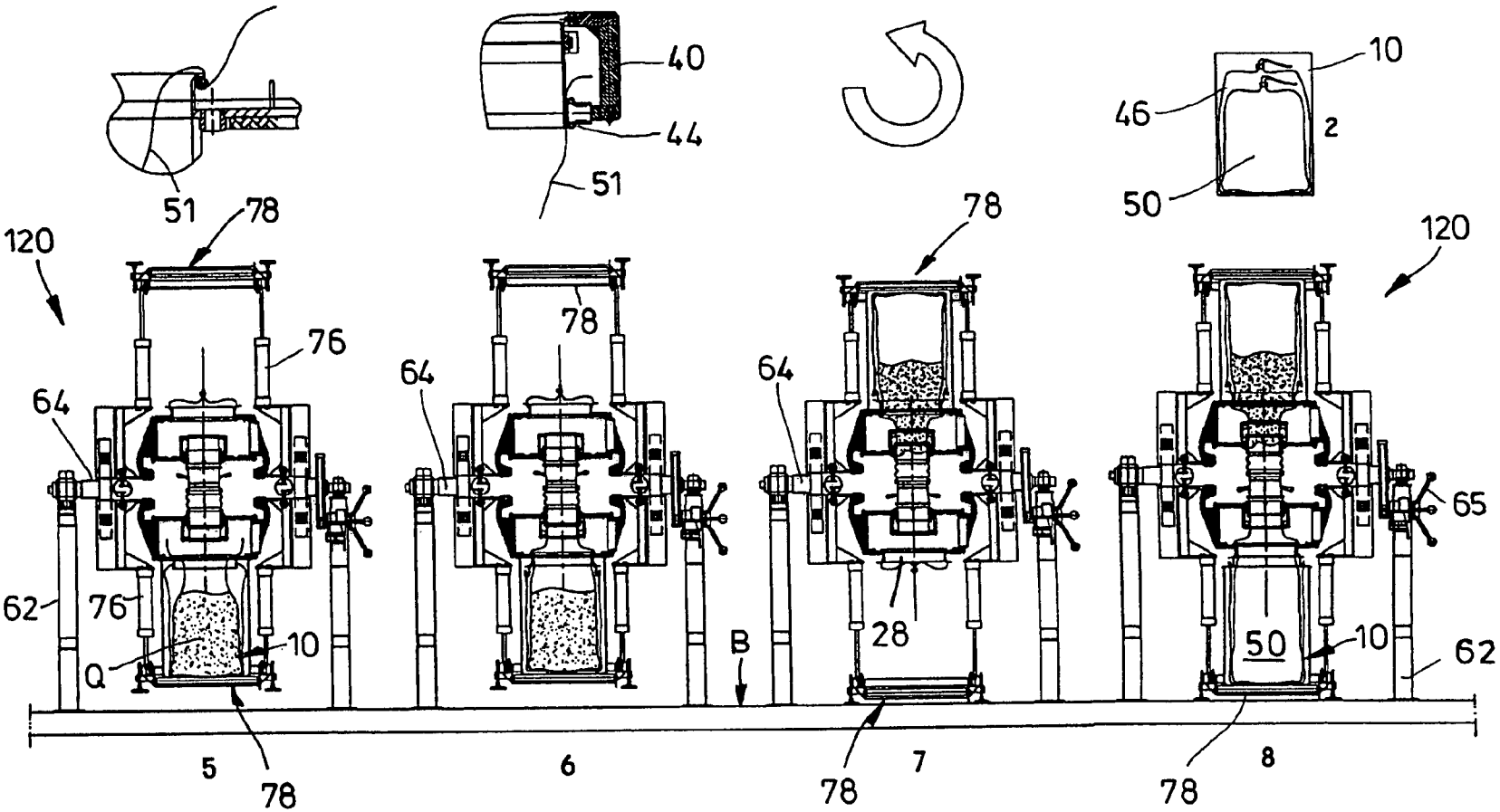
Figures 32, 33, 34, 35:
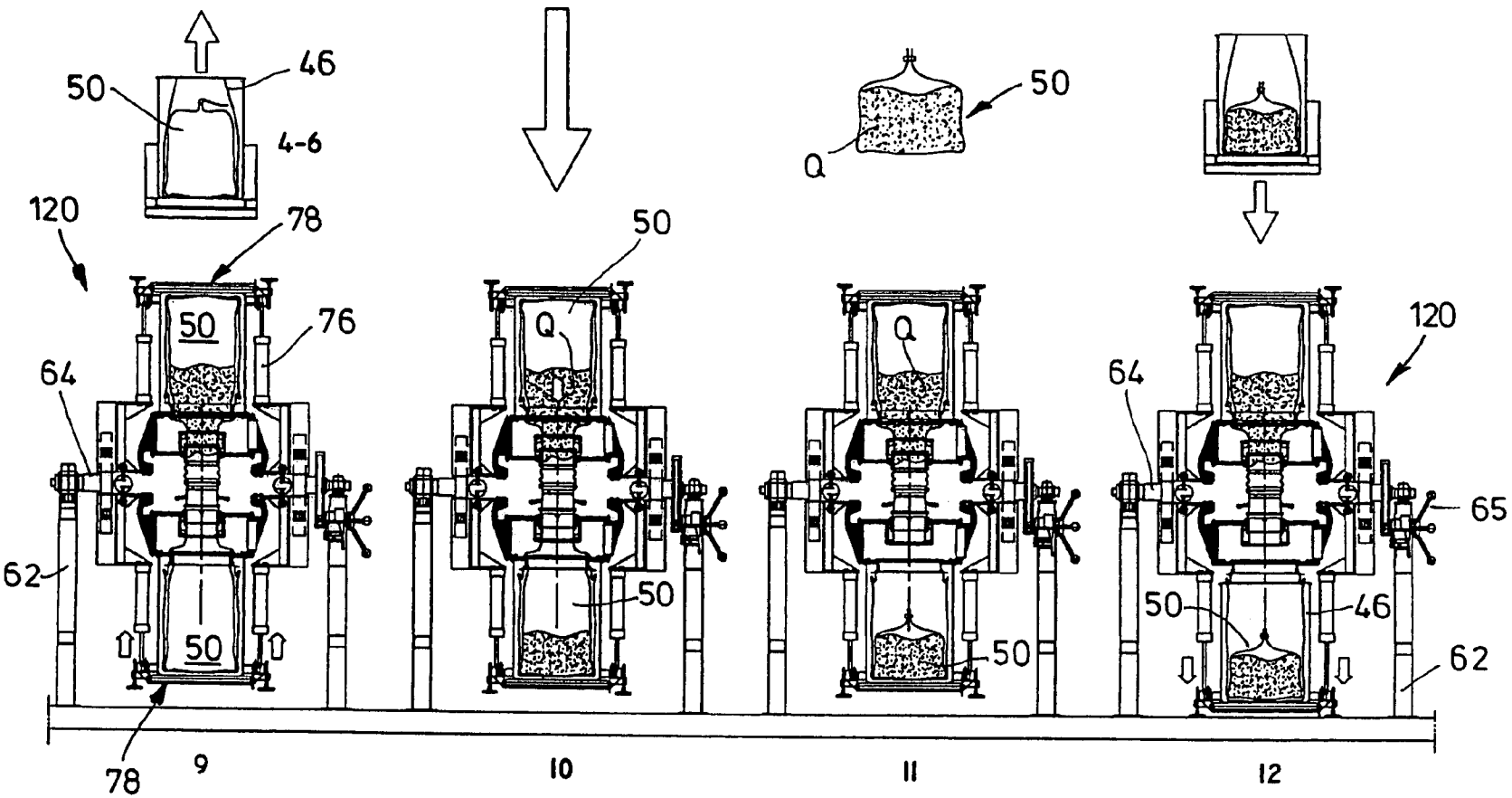
Figures 36, 37:
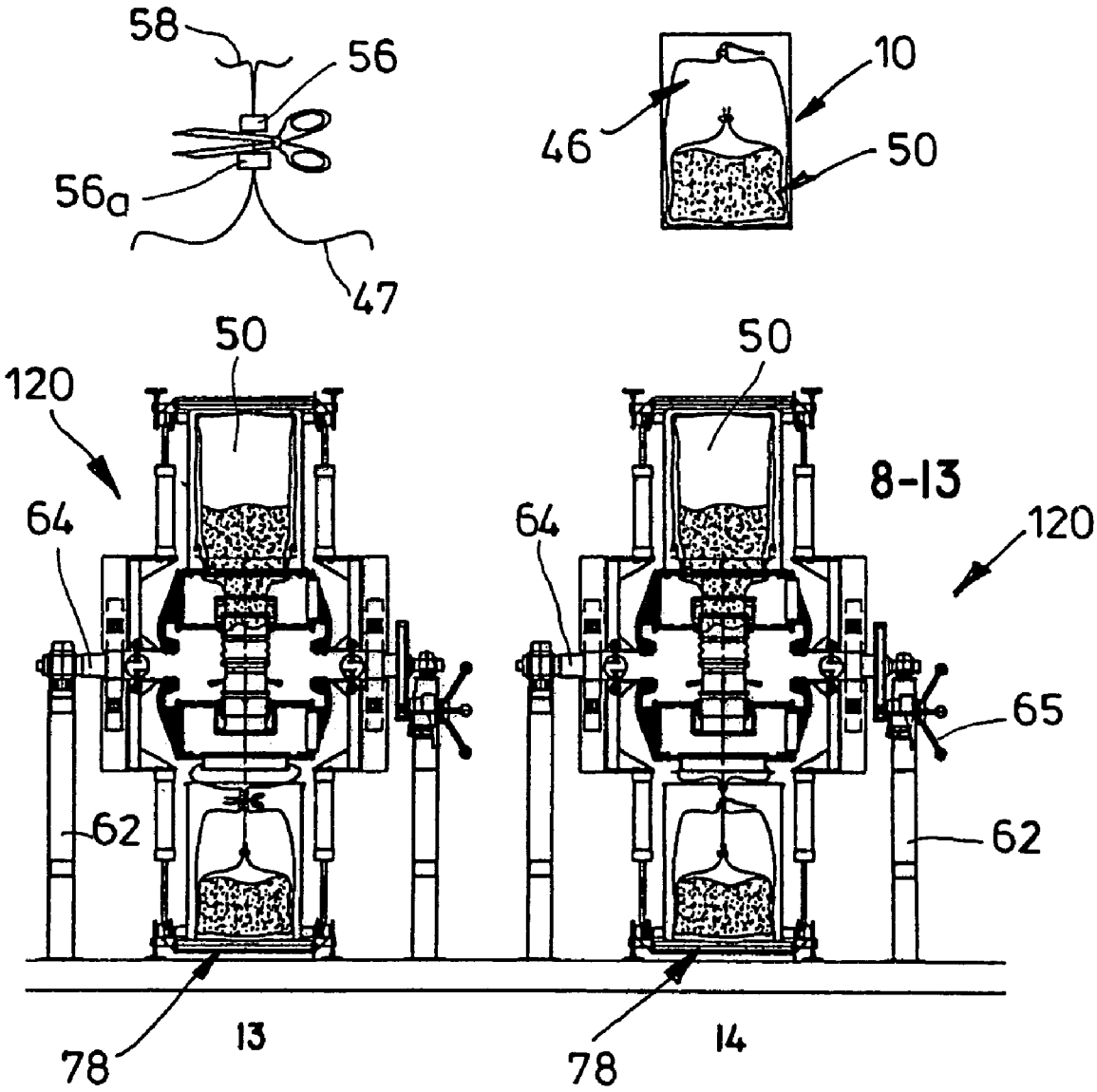

FIGS. 24 to 37 show fourteen steps of the method; the diagrams which can be seen in each case above the apparatus 120 are intended to illustrate the individual steps, for example the insertion of two bags 46, 50 into a drum 10 in the first step (FIG. 24). The fixing of the mouth region 47 of the outer covering bag 46 to the profile ring 28 in the second step is shown in FIG. 25, and then FIG. 26 shows the shortening of the piston/cylinder units 76—and the lifting of the drum 10—in the third step. The removal of the tension face 54, the opening of the inner bag 50 and the clamped fixing of the mouth region 51 thereof by means of the pressure ring 44 can be seen in FIGS. 27 to 29, and the rotation of the shaft 64—together with the lowering of the support plate 78 which is now close to the base onto the adjustable base B—is shown in FIG. 30. The insertion of a drum 10 containing two bags into the support plate 78 close to the base can be seen in FIG. 31, and the opening of the bag 46, 50 as a ninth step can be seen in FIG. 32. The metering of the powder Q within the top inner bag 50 with partial transfer to the bottom inner bag 50 is shown in FIG. 33, and closure of said inner bag is shown in FIG. 34. The steps of closing the outer covering bag 46 and separating it from the tension face 58 remaining on the profile ring 28 then follow. Finally, FIG. 37 shows the closing of the drum 10 containing the metered amount of powder.

Figure 38:
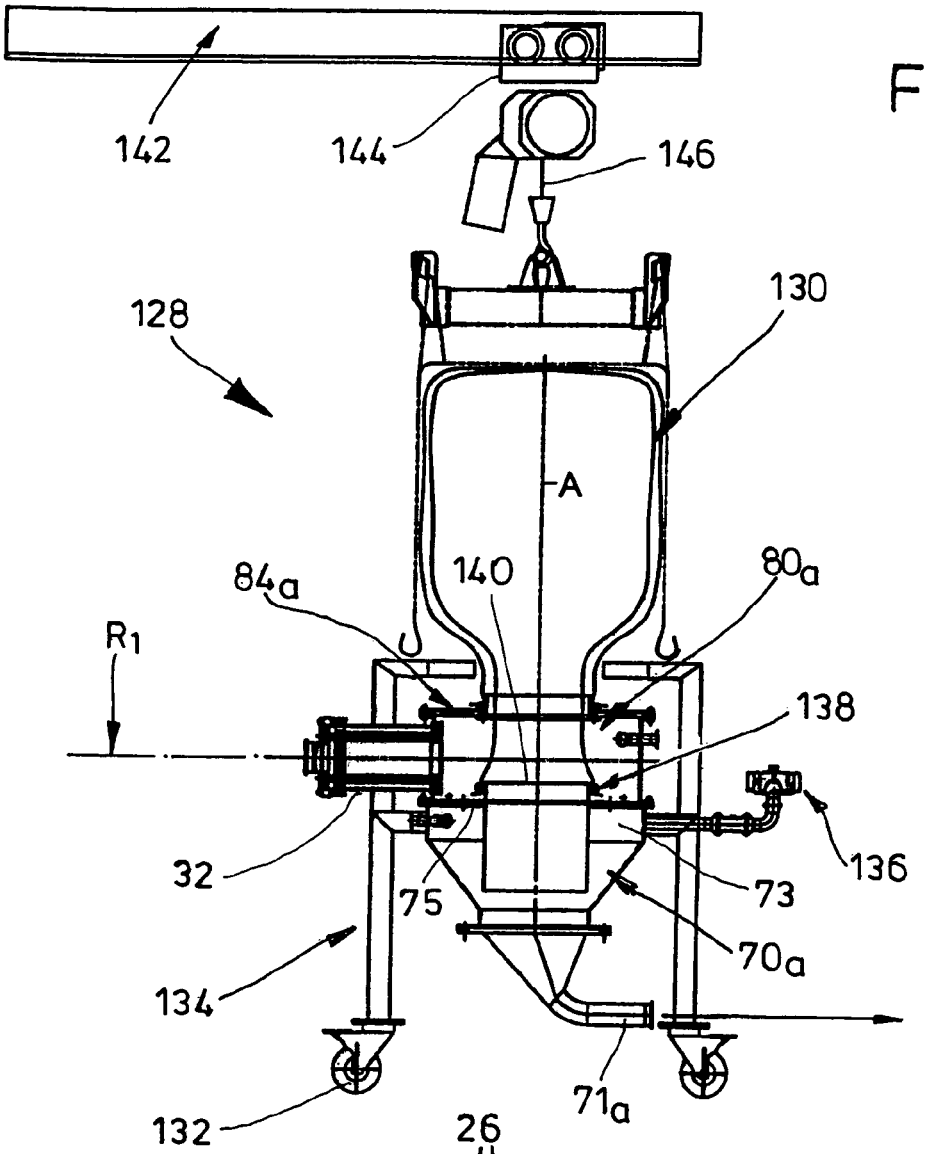
FIG. 38 shows a schematic diagram of a displaceable holding apparatus.
Figure 39:
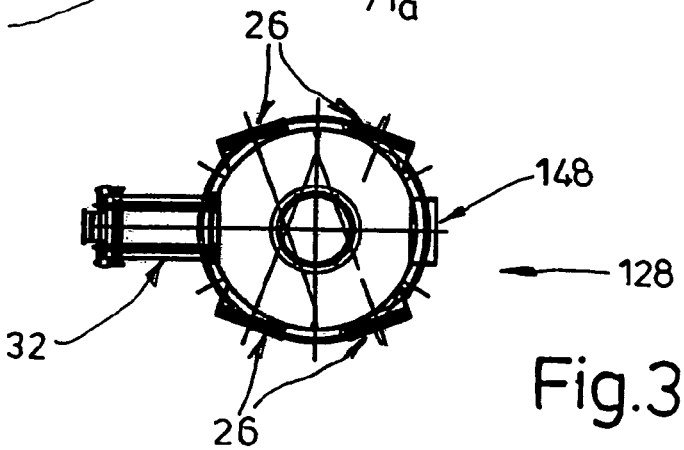
FIG. 39 shows the cross section through FIG. 38 in the radial plane R thereof.

FIGS. 38, 39 show that a system 128 according to the invention can be used to empty not just drums 10 but also a so-called big bag 130 with a glued-in double liner. In this case, a filling funnel $\mathbf{70}_a$ which is open towards the base is arranged in a movable support frame 134 having travelling rollers 123. Extending from the filling funnel $\mathbf{70}_a$ is a joining tube $\mathbf{71}_a$ for a conveying line 88, which leads for example to the reactor 92 shown in FIG. 18. At the upper funnel edge 73 there is a filter 136 for the conveying. The mouth edge 140 of the big bag 130 is seated on an inflatable seal 138, this being surrounded by a horizontal glass plate $\mathbf{84}_a$; the latter engages over the hood system $\mathbf{80}_a$.

A conveying rail 142 for a carriage 144 with a suspension device 146 for the simplified transport of the big bag 130 which can be suspended thereon can be seen above the movable support frame 134.

The cross section of FIG. 39 shows, on the hood system $\mathbf{80}_a$, a filter 32, two pairs of gloves 26 and a waste opening 148.

The invention claimed is:

1. Apparatus for decanting pulverulent product (Q) into a receptacle (50) made of deformable material, in particular into a bag, which receptacle or bag is arranged in a container (10, $\mathbf{10}_a$) made of rigid material and is temporarily placed upstream of a lock system containing a so-called glove box, wherein a shaft (64) is rotatably mounted at a distance (n) from an adjustable base (B), on which shaft at least one hood (22), at least one hood trough (80) or a hood system ($\mathbf{80}_a$, $\mathbf{80}_b$) is fixed, wherein at least one support plate (78) for the rigid container (10, $\mathbf{10}_a$) is attached to length-adjustable piston/cylinder units (76) at an adjustable distance ($n_1$) from the shaft (64), said support plate being parallel to the shaft longitudinal axis (N), and the rigid container is designed at the other end in such a way that it can be sealingly connected to a connecting tube (34, $\mathbf{34}_a$) which projects into the hood (22) or the hood trough (80) or the hood system ($\mathbf{80}_a$, $\mathbf{80}_b$).

2. Apparatus according to claim 1, wherein the shaft (64) is rotatably mounted on at least two side stands (62) which are arranged at a lateral distance (e) from one another and form a main frame.

3. Apparatus according to claim 1, wherein the hood (22) or the hood trough (80) or the outer region of the hood system ($\mathbf{80}_a$, $\mathbf{80}_b$) is formed of metallic material, preferably of stainless steel, and is provided at least in the part remote from the base with a window element (84, $\mathbf{84}_a$), wherein glove-like devices (26) are provided in openings at a front region.

4. Apparatus according to claim 1, wherein a cylindrical shape of the hood (22) or hood trough (80), the cross section of which is adapted to that of the rigid container (10, $\mathbf{10}_a$).

5. Apparatus according to claim 1, wherein the hood trough (80) is provided with an annular side wall (82) and is designed in a bowl-shaped manner, wherein two shaft-parallel plates (84, 87) are assigned to the side wall and one of these plates is passed through by the connecting tube ($\mathbf{34}_a$), wherein the plate (84) is optionally formed of a glass material (FIG. 16).

6. Apparatus according to claim 1, wherein the rigid container (10, $\mathbf{10}_a$) is designed such that it can be connected to the hood (22) or hood trough (80) or hood system ($\mathbf{80}_a$, $\mathbf{80}_b$) by pneumatic pistons which are provided at the side, wherein at least one seal (25) is assigned to the stop face for the container.

7. Apparatus according to claim 1, wherein the hood (22) or hood trough (80) or hood system ($\mathbf{80}_a$, $\mathbf{80}_b$) is fitted in a receiving compartment (66, $\mathbf{66}_a$) of the shaft (64), from which the piston/cylinder units (76) for the support plate (78) project.

8. Apparatus according to claim 7, wherein a pair of substantially radial end walls (67) of the receiving compartment (66, $\mathbf{66}_a$) which are close to the shaft mountings (63) of the side stands (62) and from which axis-parallel longitudinal walls (68) project in each case, wherein two longitudinal walls which are aligned with one another are designed as connection elements for the piston/cylinder units (76).

9. Apparatus according to claim 8, wherein the hood (22) or hood trough (80) or hood system ($\mathbf{80}_a$, $\mathbf{80}_b$) is fixed to the longitudinal walls (68) of the receiving compartment (66, $\mathbf{66}_a$) which are remote from the piston/cylinder units (76).

10. Apparatus according to claim 9, wherein the hood (22) or hood trough (80) or hood system ($\mathbf{80}_a$, $\mathbf{80}_b$) extends through at least one shaft-parallel flat plate (84) made of glass-like material, which is passed through by the connecting tube (34, $\mathbf{34}_a$).

11. Apparatus according to claim 10, wherein a tension frame (38) which surrounds the connecting tube (34, $\mathbf{34}_a$), by means of which tension frame a pressing pressure can be generated on the outer face of the tube wall (35).

12. Apparatus according to claim 11, wherein a pressure ring (44) of the tension frame (38) is assigned to the tube wall (35) and said pressure ring is designed to be displaceable in a radial and/or axis-parallel direction.

13. Apparatus according to claim 12, including an inflatable profile as pressure ring (44).

14. Apparatus according to claim 13, including at least one sliding foot (43) which guides the pressure ring (44), surrounds an axis-parallel tension arm (40) of the tension frame (35) and can be displaced and fixed on said tension arm in an axis-parallel manner.

15. Apparatus according to claim 14, wherein a mouth region (51) of the receptacle (50) made of deformable material can be fixed between the tension frame (38) and the connecting tube (34, $\mathbf{34}_a$).

16. Apparatus according to claim 15, wherein the receptacle (50) for receiving the pulverulent product (Q) is arranged as an inner bag within an outer bag (46) which surrounds it, and both bags are held in the rigid container (10, $\mathbf{10}_a$).

17. Apparatus according to claim 16, wherein, for the mouth region (47) of the covering or outer bag (46), an annular fixing device (28) is attached to an opening (23) of the hood (22) or hood trough (80) or hood system ($\mathbf{80}_a$, $\mathbf{80}_b$), which opening is to be assigned to the rigid container (10, $\mathbf{10}_a$).

18. Apparatus according to claim 17, wherein a profile ring (28) which surrounds the opening (23), wherein the outer face of said profile ring is assigned at least one pressure profile (30, 31) as a clamping element for the mouth region (47) of the outer bag (46).

19. Apparatus according to claim 18, wherein an outer foot web (29) of the profile ring (28) as a support for a pressure profile (31).

20. Apparatus according to claim 1, wherein the connecting tube ($34_a$) is connected to a pneumatic conveyor system (88) by means of a connecting element (70).

21. Apparatus according to claim 20, wherein the connecting element (70) tapers away from the connecting tube ($\mathbf{34}_a$) in a funnel-like manner.

22. Apparatus according to claim 21, wherein the connecting element (70) is equipped with a device (74) which breaks up agglomerations in the pulverulent product (Q) (FIG. 20).

Figure 23:
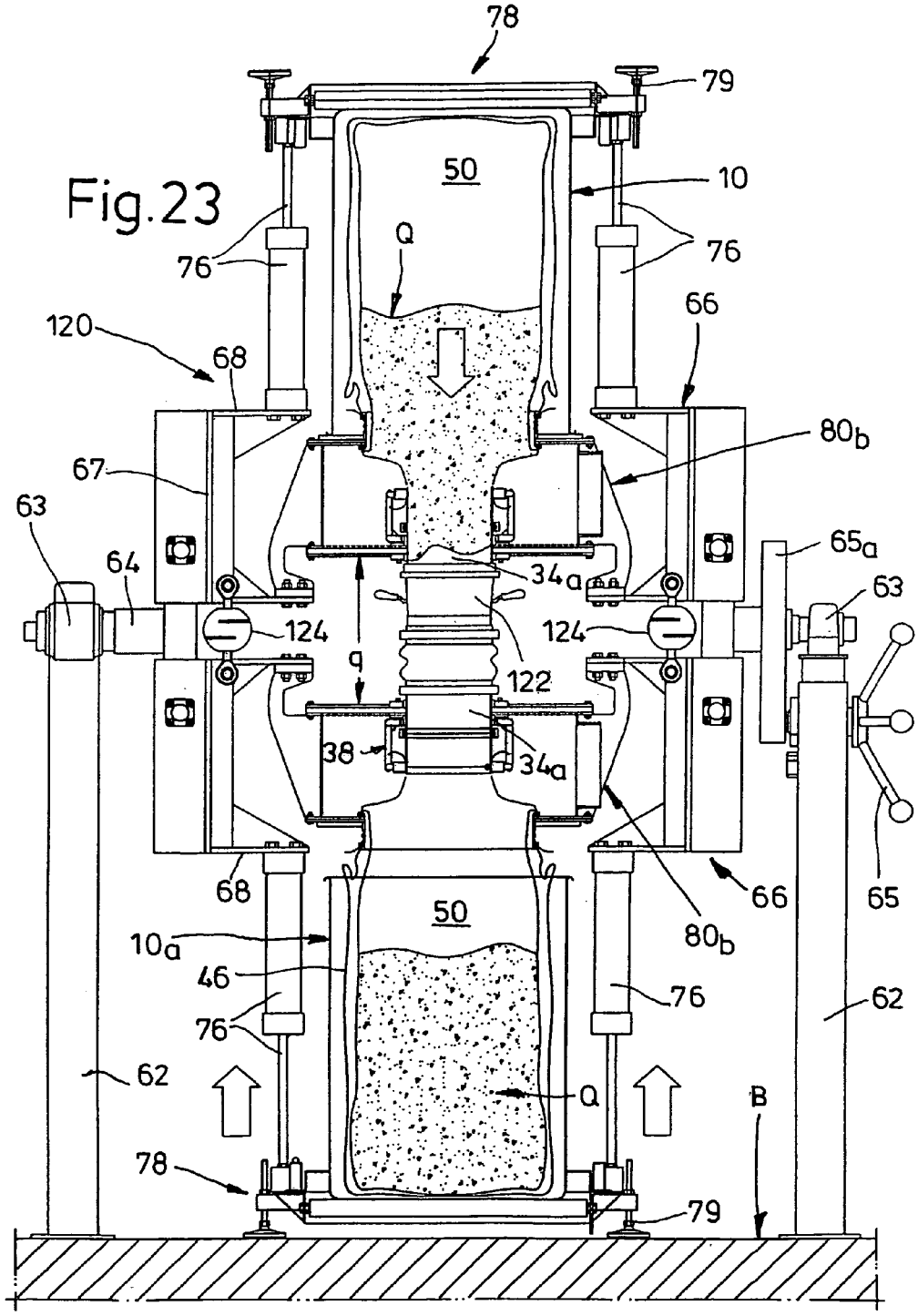

23. Apparatus according to claim 22, wherein a two hood systems ($80_b$) are assigned to the shaft (64) at a distance (q)

from one another, and their coaxial connecting tubes ($34_a$) are connected by a metering valve (122) (FIG. 23).

24. Apparatus according to claim 23, wherein piston/cylinder units (76) which are in each case provided with a support plate (78) project from the two hood systems ($80_b$) in opposite directions to one another.

25. Apparatus according to claim 24, wherein weighing elements (124) are provided between the opposed hood systems ($80_b$).

26. Apparatus according to claim 1, including a tilting device which can be actuated manually or automatically and is designed for an angle of rotation of at least 180°.

27. Apparatus according to claim 1, wherein a processing unit (110) which can rotate with the shaft (64) is arranged on the latter, from which processing unit the connecting tube ($34_a$) extends in the radial direction with respect to the shaft, wherein one compartment half (112$_t$) of the processing unit which holds said connecting tube is assigned to the receiving compartment (66$_a$) of the apparatus (61) and the other compartment half is provided with a closable filling element (111) (FIG. 21).

28. Apparatus according to claim 27, including at least one compartment half (112, 112$_t$) which in terms of its cross section tapers away from the shaft (64).

29. Apparatus according to claim 28, wherein a closure member (116) is arranged between the connecting tube (34$_a$) and the compartment half (112$_t$) which tapers towards the connecting tube.

30. Apparatus according to claim 29, wherein a common bushing (113) which surrounds the shaft (64) adjoins the compartment halves (112, 112$_t$) on either side.

31. Apparatus according to claim 30, wherein a radial panel element (114) for connection to the receiving compartment ($66_a$) is fixed to the bushing (113).

32. Apparatus according to claim 31, wherein a motor (M) is connected to the shaft (64).

33. Method for decanting pulverulent product (Q) into a receptacle (50) made of deformable material, in particular into a bag, which receptacle or bag is arranged in a container (10, 10$_a$) made of rigid material and is temporarily placed upstream of a lock system containing a so-called glove box, in particular using the apparatus according to claim 1, wherein the bag (50) which receives the product (Q) is placed in another bag (26) and is arranged together with the latter in the rigid container (10, 10$_a$), whereupon the rigid container is sealingly connected to a gloves containing hood (22) or to a hood trough (80) or to a hood system (80$_a$, 80$_b$) and the mouth region (25) of the open inner bag is connected to a connecting tube (34).

34. Method according to claim 33, wherein the product (Q) is fed to another inner bag in a metered manner and/or that the product (Q) is fed to a reactor (92).

35. Method according to claim 34, wherein the product (Q) is fed to a reactor (92).

* * * * *